United States Patent [19]

Plasker et al.

[11] Patent Number: 4,912,899

[45] Date of Patent: Apr. 3, 1990

[54] DRYWALL EDGE REVEAL TRIM STRIP

[76] Inventors: John C. Plasker, 15631 NE. 107th Ct., Redmond, Wash. 98052; Jerry L. Ward, 4705 Acorn Ave., Sioux Falls, S. Dak. 57105

[21] Appl. No.: 330,679

[22] Filed: Mar. 30, 1989

[51] Int. Cl.[4] ..... E04B 2/74

[52] U.S. Cl. ..... 52/241; 52/287; 52/417; 52/255

[58] Field of Search ..... 52/288, 287, 241, 242, 52/276, 254, 255, 256, 257, 417

[56] References Cited

U.S. PATENT DOCUMENTS

| | | | |
|---|---|---|---|
| 1,662,287 | 3/1928 | Weitz | 52/255 |
| 1,813,173 | 7/1931 | Kuehn | 52/255 |
| 2,593,859 | 4/1952 | Dunlap . | |
| 3,047,112 | 7/1962 | Tvorik | 52/288 |
| 3,201,910 | 8/1965 | Keese | 52/255 |
| 3,238,679 | 2/1966 | Capoccia | 52/254 |
| 3,370,390 | 2/1968 | Livermore | 52/255 |
| 3,420,021 | 1/1969 | Anghinetti | 52/288 |
| 4,074,478 | 2/1978 | Rutherford | 52/98 |
| 4,151,692 | 5/1979 | Holcombe | 52/404 |
| 4,587,781 | 5/1986 | Uttley et al. | 52/242 |
| 4,598,516 | 7/1986 | Groshong | 52/241 |
| 4,763,455 | 8/1988 | Schneller | 52/255 |

FOREIGN PATENT DOCUMENTS

| | | | |
|---|---|---|---|
| 1289328 | 2/1962 | France | 52/254 |

*Primary Examiner*—John E. Murtagh

*Attorney, Agent, or Firm*—Ward Brown; Robert W. Beach

[57] ABSTRACT

In conventional drywall construction, a drywall sheet is installed on upright studs with a top edge of the sheet spaced below a top plate or track. A novel rigid trim strip of generally M cross section has a horizontal top lip or first leg resting on the top plate, an upright reveal portion or a second leg extending downward from the first leg alongside the top plate, a horizontal ledge portion or third leg extending outward from the bottom of the second leg and an upright fourth leg extending downward from the third leg alongside the drywall sheet. Finishing compound is applied to mask the fourth leg. The result is a uniform reveal along the upper edge of the drywall sheet.

3 Claims, 2 Drawing Sheets

DRYWALL EDGE REVEAL TRIM STRIP

BACKGROUND OF THE INVENTION

1. Field of the Invention

The present invention relates to trim edging applied in situ during drywall construction, and particularly to a trim strip used to achieve an attractive and uniform reveal between the top edges of upright drywall sheets and the underside of a ceiling.

2. Prior Art

The most common trim strip used in finishing drywall edges is of L cross section. For example, FIG. 1 and FIG. 2 of Dunlap U.S. Pat. No. 2,593,859, issued Apr. 22, 1952, show such a trim strip applied at an outside corner where mutually perpendicular drywall sheets abut.

L section trim strips also have been used when it is desired to have a narrow reveal between the top edges of drywall sheets and a ceiling. In that instance, the top plate or track of the supporting structure can be painted black to emphasize the reveal prior to installation of the drywall sheets. An L section trim strip is applied with one leg or flange extending over the top edges and the other leg or flange extending downward and overlying the top margin of the upright panel. Plasterlike finishing compound is applied over the downward-extending flange and feathered toward the panel to mask the trim strip, usually with an intermediate strip of joint tape.

FIG. 4 of Dunlap Pat. No. 2,593,859 discloses a modified trim strip of generally Z cross section having parallel offset flanges projecting oppositely from a central web. Dunlap proposed that such modified Z section trim strip be utilized when a set back of the drywall edge is desired adjacent to a door or window jamb. The same general type of Z section strip designated "shadow mold" is sold by Flannery, Inc. of Pacoima, California, to form a reveal along inside corners including horizontal inside corners formed between the top of a wall partition and a ceiling.

Groshong U.S. Pat. No. 4,598,516, issued July 8, 1986, discloses a modified L section trim strip designed for use with suspended ceilings; and Uttley et al. U.S. Pat. No. 4,587,781, issued May 13, 1986, and Rutherford U.S. Pat. No. 4,074,478, issued Feb. 21, 1978, disclose trim strips of generally T cross section that may be utilized with suspended ceilings.

SUMMARY OF THE INVENTION

The principal object of the present invention is to provide a novel system for achieving a uniform reveal of a desired width along the underside of a ceiling adjacent to a wall.

It also is an object to provide such a system which can be utilized in substantially standard drywall construction without complicated or expensive modifications, particularly in commercial drywall construction where metal supporting structure and suspended ceilings are common.

In accordance with the above objects, it is an object to provide a novel trim strip which simplifies the procedure of achieving a desired reveal adjacent to the ceiling which trim strip is of simple and inexpensive but sturdy construction and easy to use.

In the preferred embodiment of the present invention, the foregoing objects are accomplished by providing a rigid trim strip of generally M cross section having a horizontal top lip or first leg for resting on the top plate or track of the supporting structure for the drywall sheets or panels, an upright reveal portion or second leg extending downward alongside such top plate or track to a position closely adjacent to the top edge of the drywall sheets or panels, a horizontal ledge portion or third leg extending outward from the bottom of the second leg over the top edge of the drywall sheets or panels, and an upright finish portion or fourth leg extending downward along the exposed surface of the top margins of the drywall sheets or panels. In cross section, the lengths of the different legs are not equal. The top lip or first leg is of a length for reliably engaging over the top plate or track to position the rigid trim strip. The length of the vertical reveal portion or second leg depends on the width of the desired reveal adjacent to the ceiling. The length of the horizontal ledge portion or third leg is approximately equal to the thickness of the drywall sheets or panels. The finish portion or fourth leg extends downward close alongside the exposed surface of the drywall for convenient finishing. The trim strip can have an intermediate bead for ease in finishing the drywall construction with conventional plasterlike finishing compound, with or without a wider strip of joint tape. If the trim strip is provided with joint tape, it is preferred that the tape extend upward above the bottom finish portion or fourth leg of the trim strip and be folded perpendicularly onto the ledge portion or third leg where it will not be seen from below. The entire trim strip can be molded of black plastic material or be of metal or plastic and painted black for a pleasing "shadow" effect.

DETAILED DESCRIPTION

Figure 1:
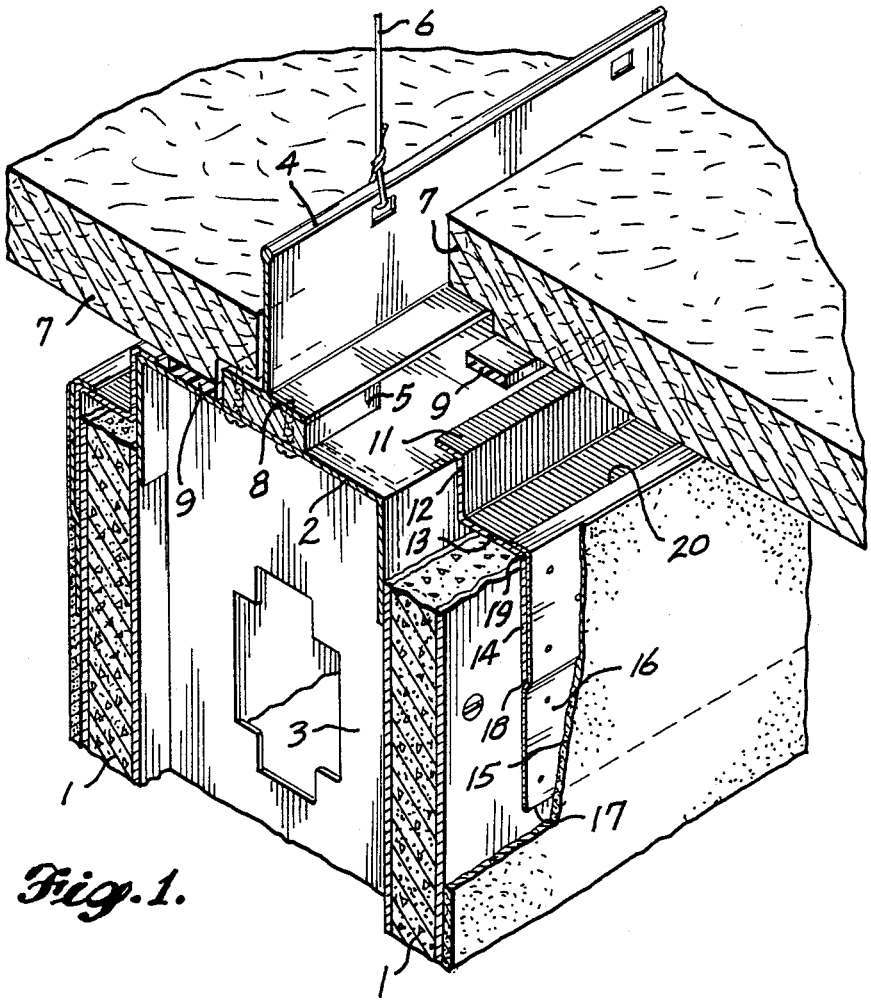
FIG. 1 is a fragmentary top perspective of a drywall construction utilizing an edge reveal trim strip in accordance with the present invention with parts broken away.

The edge reveal trim strip in accordance with the present invention is intended to be used in standard drywall construction of which the construction shown in FIG. 1 is representative. Partition support structure for the drywall panels or sheets 1 includes a top plate such as the inverted metal channel or track 2 extending over spaced studs 3. The ceiling support structure includes a network of inverted T-bars 4 resting on spacers 5 which, in turn, are mounted on the top plate or track 2. The inverted T-bars are at least partially supported by suspension wires, such as the wire 6 shown in FIG. 1. Standard Ceiling tiles 7 are supported on the oppositely projecting bottom flanges 8 of the inverted T-bars and can be notched so that the undersides of the tiles engage against thin continuous resilient strips 9 laid on the top plate or track 2 for added soundproofing.

A pleasing ascetic "shadow" effect can be achieved if the top edges of the drywall panels are uniformly spaced below the top of the top plate or track 2 and finished to provide a long straight edge. In the past such finishing usually was performed by installing a standard rigid L section trim strip having a short horizontal leg extending over the top edge of the drywall and a longer upright leg extending downward alongside the drywall with, for example, a corner bead for ease in masking the trim strip by use of standard plasterlike finishing compound. Nevertheless, in the conventional construction, it can be difficult and time-consuming to position the L section trim strip with its central bend precisely parallel to the ceiling. It also can be difficult to maintain the strips in position while the finishing process is completed.

In accordance with the present invention, after installation of the wall panels 1 on the partition supporting structure 2, 3 with their top edges no higher than the desired reveal, a trim strip of generally M cross section is applied. Such strip has a top lip or first leg portion 11 hooked over and resting on the top plate or track 2. A reveal portion or second leg 12 of the trim strip extends downward alongside the track for a distance approximately equal to the width of the desired reveal. A ledge portion or third leg 13 extends horizontally outward from the bottom of the second leg 12 over the top edge of the drywall and is of a length approximately equal to the thickness of the drywall. A finish portion or fourth leg 14 of the trim strip extends downward from the outer edge of the third leg 13 closely alongside the otherwise exposed surface of the drywall panel 1 to be finished.

Prior to installation of the trim strip, a thin layer of finishing compound can be applied along the inner side of the downward-extending fourth leg 14. The adhesiveness of such inner layer of finishing compound in combination with the snug fit of the trim strip and the top lip 11 resting on the plate or track 2 maintains the strip reliably in position while the outer layer 15 of finishing compound is applied.

Figure 2:
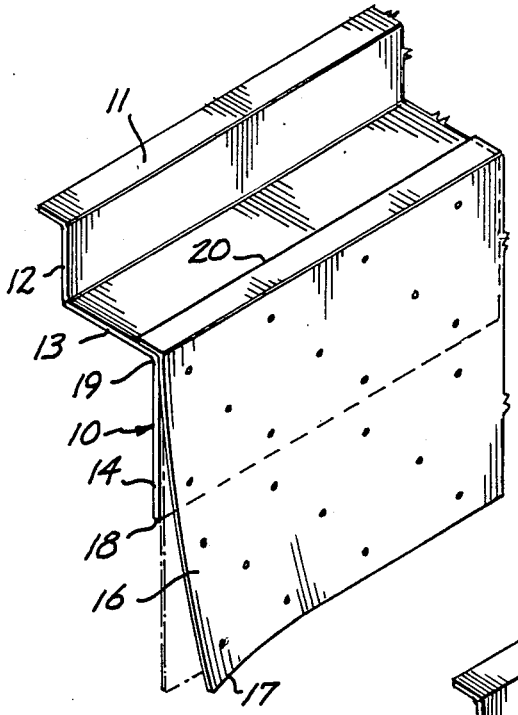
FIG. 2 is a fragmentary top perspective of the edge reveal trim strip of the construction of FIG. 1.

In the embodiment illustrated in FIGS. 1 and 2, a continuous strip of joint tape 16 is adhesively secured to the trim strip third and fourth legs 13 and 14. As best seen in FIG. 2, the joint tape has a bottom edge 17 positioned a substantial distance below the bottom edge 18 of the fourth leg 14 of the trim strip 10 and is folded over the junction 19 between the fourth leg and third leg 13 to an inner edge 20. Consequently, the top inner edge 20 of the joint tape does not interfere with conventional finishing of upright outer surface of the drywall and is not visible from below.

Figure 3:
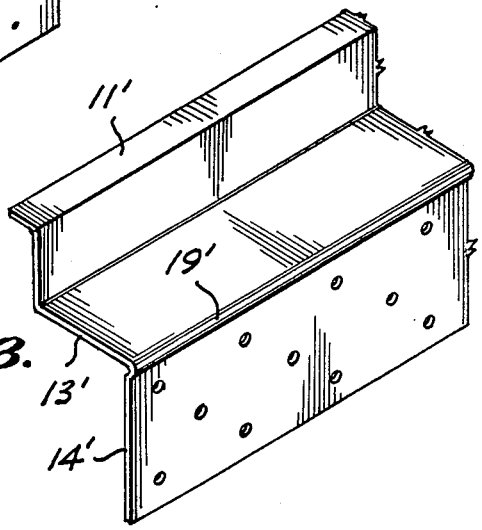
FIG. 3 is a fragmentary top perspective of a modified form of drywall edge reveal trim strip in accordance with the present invention.
Figure 4:
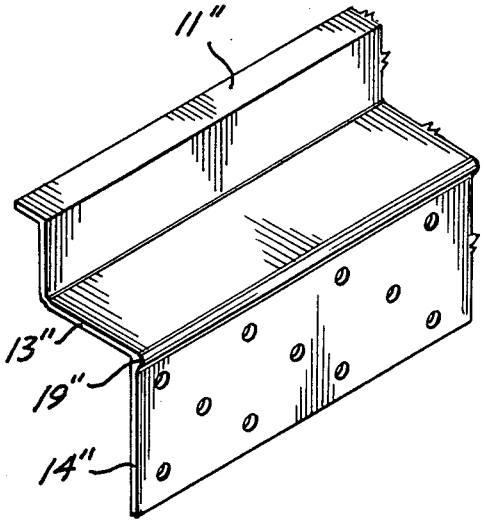
FIG. 4 is a fragmentary top perspective of another modified form of drywall edge reveal trim strip in accordance with the present invention.

The embodiment of the invention illustrated in FIGS. 1 and 2 can be formed of any convenient, inexpensive, rigid material but preferaby has a black finish to emphasize the shadow effect of the reveal. The modified embodiment shown in FIG. 3 is formed of metal substantially return bent from the outer edge of the third leg portion 13' to the upper edge of the fourth leg portion 14' to form the outward-projecting corner bead 19'. The modified embodiment illustrated in FIG. 4 is extruded plastic with a thicker rounder bead portion 19'' between the outer edge of the third leg 13'' and the upper edge of the fourth leg 14''. Such a protruding bead portion 19' or 19'' can simplify quick and neat finishing with the plasterlike finishing compound without interfering with the appearance of the reveal and without unduly complicating manufacture of the trim strip. Regardless of the embodiment which is used, installation is quicker, easier and more reliable because the top lip 11, 11' or 11'' of the strip rests on the top plate of the partition supporting structure and always will be parallel to the underside of the ceiling.

We claim:

1. An edge reveal trim strip for a static building construction having a partition including supporting structure with a top plate and an upright wall panel installed on such supporting structure, such panel including a top edge spaced below the top of such top plate, said strip comprising an elongated length of rigid material of generally M cross section including a top leg having a portion for resting on the top plate, a second leg having a portion for extending alongside the top plate, a third leg for extending outward over the top edge of the panel and a fourth leg for extending downward alongside the panel.

2. In a drywall construction including a horizontal top plate, upright studs and a drywall sheet installed on said studs, such sheet having a top edge spaced below the top of the top plate, the improvement comprising an edge reveal trim strip having a top lip resting on the top plate, a reveal portion extending downward alongside the top plate, a ledge portion extending outward from the top plate over the top edge of the drywall sheet and closely adjacent thereto, and a bead portion projecting outward beyond the exposed surface of the drywall sheet for application of finishing compound from said bead portion downward feathered into said drywall surface.

3. In the drywall construction defined in claim 2, the improvement further comprising the trim strip including a fourth leg extending downward from the ledge portion close alongside the exposed surface of the drywall sheet.

* * * * *